US010066174B2

(12) United States Patent
Ladkat et al.

(10) Patent No.: US 10,066,174 B2
(45) Date of Patent: Sep. 4, 2018

(54) PROCESS AND APPARATUS FOR HYDROTREATING FRACTIONATED OVERHEAD NAPHTHA

(71) Applicant: UOP LLC, Des Plaines, IL (US)

(72) Inventors: Kiran Ladkat, Gurgaon (IN); Richard K. Hoehn, Mount Prospect, IL (US); Neeraj Tiwari, Haryana (IN)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/458,690

(22) Filed: Mar. 14, 2017

(65) Prior Publication Data

US 2017/0275540 A1 Sep. 28, 2017

Related U.S. Application Data

(60) Provisional application No. 62/311,742, filed on Mar. 22, 2016.

(51) Int. Cl.
*C10G 65/02* (2006.01)
*C10G 67/02* (2006.01)

(52) U.S. Cl.
CPC ..... *C10G 67/02* (2013.01); *C10G 2300/202* (2013.01)

(58) Field of Classification Search
CPC ... C10G 67/02; C10G 65/12; C10G 2300/202
See application file for complete search history.

(56) References Cited

U.S. PATENT DOCUMENTS

| | | | | |
|---|---|---|---|---|
| 3,430,418 | A | 3/1969 | Wagner | |
| 4,363,718 | A | 12/1982 | Klotz | |
| 5,885,440 | A * | 3/1999 | Hoehn | C10G 65/12 208/108 |
| 7,097,760 | B1 | 8/2006 | Kalnes | |
| 7,629,289 | B2 | 12/2009 | Bauer et al. | |
| 2006/0118466 | A1 | 8/2006 | Galeazzi et al. | |
| 2007/0138058 | A1 | 6/2007 | Farshid et al. | |
| 2012/0048776 | A1 | 3/2012 | Podrebarac et al. | |
| 2013/0046125 | A1 * | 2/2013 | Hoehn | C10G 67/00 585/841 |
| 2014/0296591 | A1 | 10/2014 | Davila Gomez et al. | |
| 2015/0014218 | A1 | 1/2015 | Bisht et al. | |

(Continued)

FOREIGN PATENT DOCUMENTS

WO 2006065643 A2 6/2006

OTHER PUBLICATIONS

PCT Search Report dated Jul. 13, 2017 for International Application No. PCT/US2017/023150.

(Continued)

*Primary Examiner* — Randy Boyer
*Assistant Examiner* — Juan C Valencia

(57) ABSTRACT

An apparatus and process for hydrodesulfurizing hydroprocessed naphtha from an overhead stream of a product fractionation column and/or from an overhead stream of a product stripping column in which an overhead stream may be condensed and fed to a post treat hydrodesulfurization reactor. Hydrogen may be supplied from an upstream separator for separating the hydroprocessed stream. Accordingly, naphtha may be hydrodesulfurized within the hydroprocessing recovery unit.

20 Claims, 1 Drawing Sheet

(56) References Cited

U.S. PATENT DOCUMENTS

2017/0275541 A1 9/2017 Ladkat et al.

OTHER PUBLICATIONS

McClung, "Reformer Feedstock Pretreatment: Liquid Phase vs. Vapor Phase Sulfur Removal Process", presented at the NPRA Annual Meeting on Mar. 19-21, 1989, San Francisco, California.
Rameshni, "Handling Vent Gases in Sulfur Plants", Hydrocarbon Engineering, Dec. 2004, pp. 39-45.
Technip, "Gas Processes 2000: Hydrogen", Hydrocarbon Processing, v 79, n 4, p. 75, Apr. 2000.

* cited by examiner

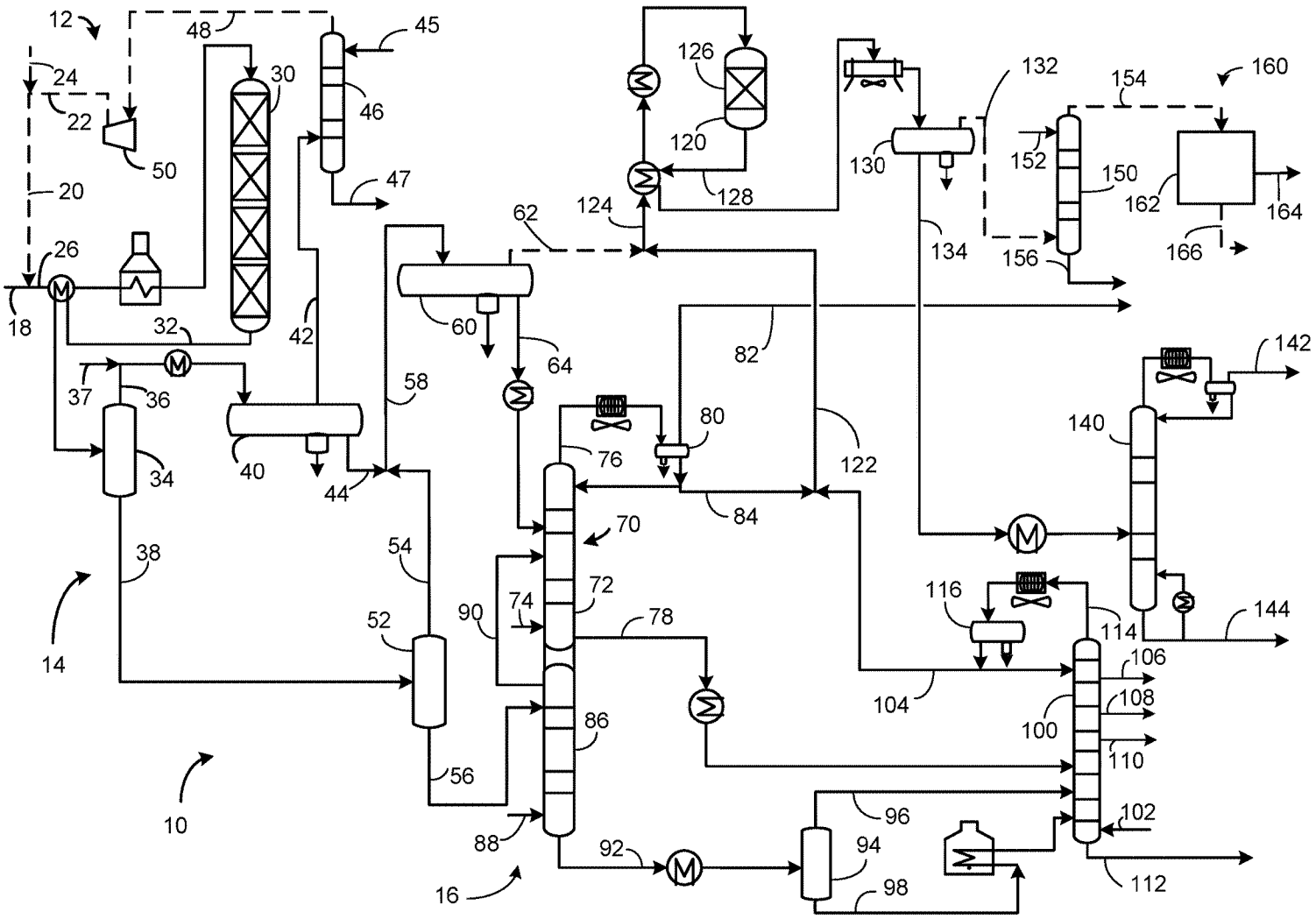
10
12
14
16
18
20
22
24
26
30
32
34
36
37
38
40
42
44
45
46
47
48
50
52
54
56
58
60
62
64
70
72
74
76
78
80
82
84
86
88
90
92
94
96
98
100
102
104
106
108
110
112
114
116
120
122
124
126
128
130
132
134
140
142
144
150
152
154
156
160
162
164
166

PROCESS AND APPARATUS FOR HYDROTREATING FRACTIONATED OVERHEAD NAPHTHA

CROSS-REFERENCE TO RELATED APPLICATION

This application claims priority from Provisional Application No. 62/311,742 filed Mar. 22, 2016, the contents of which are hereby incorporated by reference.

FIELD

The field is the hydrotreating of naphtha streams, particularly overhead naphtha streams from a hydroprocessing unit.

BACKGROUND

Hydroprocessing can include processes which convert hydrocarbons in the presence of hydroprocessing catalyst and hydrogen to more valuable products. Hydrocracking is a hydroprocessing process in which hydrocarbons crack in the presence of hydrogen and hydrocracking catalyst to lower molecular weight hydrocarbons. Depending on the desired output, a hydrocracking unit may contain one or more fixed beds of the same or different catalyst. Slurry hydrocracking is a slurried catalytic process used to crack residue feeds to gas oils and fuels.

In many regions naphtha is useful for motor fuel and petrochemical feed stock and its further recovery is desirable. Due to environmental concerns and newly enacted rules and regulations, saleable fuels must meet lower and lower limits on contaminates, such as sulfur and nitrogen. New regulations require essentially complete removal of sulfur from gasoline. For example, the U.S. Environmental Protection Agency is promulgating Tier 3 Motor Vehicle Emission and Fuel Standards in 2017 which limits gasoline sulfur to 10 wppm.

Hydrotreating is a hydroprocessing process used to remove heteroatoms such as sulfur and nitrogen from hydrocarbon streams to meet fuel specifications and to saturate olefinic or aromatic compounds. Hydrotreating can be performed at high or low pressures, but is typically operated at lower pressure than hydrocracking. Hydrodesulfurization is a hydrotreating process aimed at removing sulfur from the hydrocarbon by converting sulfur to hydrogen sulfide.

Hydroprocessing recovery units typically include an array of separators for cooling and depressurizing hydroprocessed effluent and separating gaseous streams from liquid streams and a stripping column for stripping hydroprocessed liquid with a stripping medium such as steam to remove unwanted hydrogen sulfide. The stripped stream then is typically heated and fractionated in a product fractionation column to recover products such as naphtha, kerosene and diesel.

In a refinery, hydrogen has a prime importance and recovery of hydrogen improves refinery profitability significantly. Pressure swing absorption (PSA) units are useful for purifying hydrogen by adsorbing larger molecules from the hydrogen stream at high pressure and then releasing the larger molecules at swing to lower pressure to provide a tail gas stream.

There is a continuing need, therefore, for improved methods of recovering low sulfur naphtha from hydroprocessed effluent streams.

BRIEF SUMMARY

We have discovered an apparatus and process for hydrodesulfurizing hydroprocessed naphtha from an overhead stream of a product fractionation column. The overhead stream may be condensed and fed to a post treat hydrodesulfurization reactor. Hydrogen may be supplied from an upstream separator for separating the hydroprocessed stream. Accordingly, naphtha may be hydrodesulfurized within the hydrocracking recovery unit.

BRIEF DESCRIPTION OF THE DRAWING

The FIGURE is a simplified process flow diagram.

DEFINITIONS

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "bypass" means that the object is out of downstream communication with a bypassing subject at least to the extent of bypassing.

As used herein, the term "a component-rich stream" means that the rich stream coming out of a vessel has a greater concentration of the component than the feed to the vessel.

As used herein, the term "a component-lean stream" means that the lean stream coming out of a vessel has a smaller concentration of the component than the feed to the vessel.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Absorber and scrubbing columns do not include a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The overhead pressure is the pressure of the overhead vapor at the vapor outlet of the column. The bottom temperature is the liquid bottom outlet temperature. Overhead lines and bottoms lines refer to the net lines from the column downstream of any reflux or reboil to the column unless otherwise indicated. Stripping columns omit a reboiler at a bottom of the column and instead provide heating requirements and separation impetus from a fluidized inert vaporous media such as steam.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "T5" or "T95" means the temperature at which 5 volume percent or 95 volume percent, as the case may be, respectively, of the sample boils using ASTM D-86.

As used herein, the term "diesel boiling range" means hydrocarbons boiling in the range of between about 132° C. (270° F.) and the diesel cut point between about 343° C. (650° F.) and about 399° C. (750° F.) using the TBP distillation method.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which latter may be operated at higher pressure.

As used herein, the term "predominant" or "predominate" means greater than 50%, suitably greater than 75% and preferably greater than 90%.

DETAILED DESCRIPTION

In a fractionation section for recovering hydroprocessed product, a naphtha stream from a stripper overhead and/or from a product fractionation overhead may be combined and routed to the stabilizing fractionation column for stabilization of the liquid streams. The sulfur content in the naphtha stream, typically due to mercaptans, is in the range of 10-50 wppm. In order to route light naphtha to an isomerization unit and heavy naphtha to a reforming unit the debutanized naphtha should meet a sulfur specification of no more than 0.1 wppm for light naphtha and no more than 0.5 wppm for heavy naphtha. A bottoms stream from a stabilizer column comprising full range naphtha may be either treated in a sulfur adsorbent bed or in a naphtha hydrotreating unit to meet the sulfur specification. However, a sulfur adsorbent bed may only last six months and requires disposal of the adsorbent. A naphtha hydrotreating unit requires a hydrogen compressor which is both operationally and capitally expensive. It is proposed to utilize a hydrodesulfurization reactor upstream of the stabilizing column to post treat the hydroprocessed naphtha to meet sulfur specifications.

The apparatus and process 10 for hydroprocessing hydrocarbons comprise a hydroprocessing unit 12, a separation section 14, a product recovery unit 16 and a hydrogen recovery unit 160. A hydrocarbonaceous stream in a hydrocarbon line 18 and a hydrogen rich stream line 24 are fed to the hydroprocessing unit 12.

A recycle hydrogen stream in recycle hydrogen line 22 may supplement the make-up hydrogen stream from line 24 to provide the hydrogen stream in the hydrogen line 20. The hydrogen stream may join the hydrocarbonaceous stream in feed line 18 to provide a hydrocarbon feed stream in feed line 26. The hydrocarbon feed stream in feed line 26 may be heated by heat exchange with hydroprocessed effluent stream in line 32 and in a fired heater and fed to the hydroprocessing reactor 30. The hydrocarbon feed stream is hydroprocessed in the hydroprocessing reactor 30.

In one aspect, the process and apparatus described herein are particularly useful for hydroprocessing a hydrocarbon feed stream comprising a hydrocarbonaceous feedstock. Illustrative hydrocarbon feedstocks include hydrocarbonaceous streams having initial boiling points (IBP) above about 288° C. (550° F.), such as atmospheric gas oils, vacuum gas oil (VGO) having T5 and T95 between about 315° C. (600° F.) and about 600° C. (1100° F.), deasphalted oil, coker distillates, straight run distillates, pyrolysis-derived oils, high boiling synthetic oils, cycle oils, hydrocracked feeds, catalytic cracker distillates, atmospheric residue having an IBP at or above about 343° C. (650° F.) and vacuum residue having an IBP above about 510° C. (950° F.).

Hydroprocessing that occurs in the hydroprocessing unit 12 may be hydrocracking or hydrotreating. Hydrocracking refers to a process in which hydrocarbons crack in the presence of hydrogen to lower molecular weight hydrocarbons. Hydrocracking is the preferred process in the hydroprocessing unit 12. Consequently, the term "hydroprocessing" will include the term "hydrocracking" herein. Hydrocracking also includes slurry hydrocracking in which residue feed is mixed with catalyst and hydrogen to make a slurry and cracked to lower boiling products.

The hydroprocessing that occurs in the hydroprocessing unit may also be hydrotreating. Hydrotreating is a process wherein hydrogen is contacted with hydrocarbon in the presence of hydrotreating catalysts which are primarily active for the removal of heteroatoms, such as sulfur, nitrogen and metals from the hydrocarbon feedstock. In hydrotreating, hydrocarbons with double and triple bonds may be saturated. Aromatics may also be saturated. Some hydrotreating processes are specifically designed to saturate aromatics. The cloud point or pour point of the hydrotreated product may also be reduced by hydroisomerization. A hydrocracking reactor may be preceded by a hydrotreating reactor and an optional separator (not shown) to remove sulfur and nitrogen contaminants from the feed to the hydrocracking reactor.

The hydroprocessing reactor 30 may be a fixed bed reactor that comprises one or more vessels, single or multiple beds of catalyst in each vessel, and various combinations of hydrotreating catalyst and/or hydrocracking catalyst in one or more vessels. It is contemplated that the hydroprocessing reactor 30 be operated in a continuous gas phase in which the volume of the liquid hydrocarbon feed is less than the volume of the hydrogen gas. The hydroprocessing reactor 30 may also be operated in a conventional continuous gas phase, a moving bed or a fluidized bed hydroprocessing reactor.

If the hydroprocessing reactor 30 is operated as a hydrocracking reactor, it may provide total conversion of at least about 20 vol % and typically greater than about 60 vol % of the hydrocarbon feed to products boiling below the diesel cut point. A hydrocracking reactor may operate at partial conversion of more than about 30 vol % or full conversion of at least about 90 vol % of the feed based on total conversion. A hydrocracking reactor may be operated at mild hydrocracking conditions which will provide about 20 to about 60 vol %, preferably about 20 to about 50 vol %, total conversion of the hydrocarbon feed to product boiling below the diesel cut point. If the hydroprocessing reactor 30 is operated as a hydrotreating reactor, it may provide conversion per pass of about 10 to about 30 vol %.

If the hydroprocessing reactor 30 is a hydrocracking reactor, the first vessel or bed in the hydrocracking reactor 30 may include hydrotreating catalyst for the purpose of saturating, demetallizing, desulfurizing or denitrogenating the hydrocarbon feed before it is hydrocracked with hydrocracking catalyst in subsequent vessels or beds in the hydrocracking reactor 30. If the hydrocracking reactor is a mild hydrocracking reactor, it may contain several beds of hydrotreating catalyst followed by a fewer beds of hydrocracking catalyst. If the hydroprocessing reactor 30 is a slurry hydrocracking reactor, it may operate in a continuous liquid phase in an upflow mode and will appear different than in FIG. 1 which depicts a fixed bed reactor. If the hydroprocessing reactor 30 is a hydrotreating reactor it may comprise more than one vessel and multiple beds of hydrotreating catalyst. The hydrotreating reactor may also contain hydrotreating catalyst that is suited for saturating aromatics, hydrodewaxing and hydroisomerization.

A hydrocracking catalyst may utilize amorphous silica-alumina bases or low-level zeolite bases combined with one or more Group VIII or Group VIB metal hydrogenating components if mild hydrocracking is desired to produce a balance of middle distillate and gasoline. In another aspect, when middle distillate is significantly preferred in the converted product over gasoline production, partial or full hydrocracking may be performed in the first hydrocracking reactor 30 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms ($10^{-10}$ meters). It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms ($10^{-10}$ meters), wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,100,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 percent, and preferably at least about 20 percent, metal-cation-deficient, based on the initial ion-exchange capacity. In another aspect, a desirable and stable class of zeolites is one wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and about 30 percent by weight may be used. In the case of the noble metals, it is normally preferred to use about 0.05 to about 2 wt % noble metal.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° C. (700° F.) to about 648° C. (1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to less than about 2.5 $hr^{-1}$ and a hydrogen rate of about 253 Nm3/m3 (1500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 253 $Nm^3/m^3$ oil (1500 scf/bbl) to about 1,685 $Nm^3/m^3$ oil (10,000 scf/bbl).

Suitable hydrotreating catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. More than one type of hydrotreating catalyst may be used in the same hydrotreating reactor 30. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred hydrotreating reaction conditions include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig), preferably 4.1 MPa (gauge) (600 psig) to about 20.6 MPa (gauge) (3000 psig), suitably 12.4 MPa (gauge) (1800 psig), preferably 6.9 MPa (gauge) (1000 psig), a liquid hourly space velocity of the fresh hydrocarbonaceous feedstock from about 0.1 $hr^{-1}$, suitably 0.5 $hr^{-1}$, to about 4 $hr^{-1}$, preferably from about 1.5 to about 3.5 $hr^{-1}$, and a hydrogen rate of about 168 $Nm^3/m^3$ (1,000 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

The hydroprocessing reactor 30 provides a hydroprocessed effluent stream that exits the hydroprocessing reactor 30 in a hydroprocessed effluent line 32. The hydroprocessed effluent stream may be separated in the separation section 14 comprising one or more separators into a liquid hydroprocessed stream and a gaseous hydroprocessed stream. The separation section 14 is in downstream communication with the hydroprocessing reactor 30.

The hydroprocessed effluent stream in hydroprocessed effluent line 32 may in an aspect be heat exchanged with the hydrocarbon feed stream in line 26 to be cooled before entering a hot separator 34. The hot separator separates the hydroprocessed effluent stream to provide a hydrocarbonaceous, hot gaseous stream in a hot overhead line 36 and a hydrocarbonaceous hot separated hydroprocessed stream in a hot bottoms line 38. The hot separator 34 may be in downstream communication with the hydroprocessing reactor 30. The hot separator 34 operates at about 177° C. (350° F.) to about 371° C. (700° F.) and preferably operates at about 232° C. (450° F.) to about 315° C. (600° F.). The hot separator 34 may be operated at a slightly lower pressure than the hydroprocessing reactor 30 accounting for pressure drop through intervening equipment. The hot separator may be operated at pressures between about 3.4 MPa (gauge) (493 psig) and about 20.4 MPa (gauge) (2959 psig). The hydrocarbonaceous hot gaseous stream in the hot overhead line 36 may have a temperature of the operating temperature of the hot separator 34.

The hot gaseous stream in the hot overhead line 36 may be cooled before entering a cold separator 40. As a consequence of the reactions taking place in the hydroprocessing reactor 30 wherein nitrogen, chlorine and sulfur are removed from the feed, ammonia and hydrogen sulfide are formed. At a characteristic sublimation temperature, ammonia and hydrogen sulfide will combine to form ammonium bisulfide and ammonia, and chlorine will combine to form ammonium chloride. Each compound has a characteristic sublimation temperature that may allow the compound to coat equipment, particularly heat exchange equipment, impairing its performance. To prevent such deposition of ammonium bisulfide or ammonium chloride salts in the hot overhead line 36 transporting the hot gaseous stream, a suitable amount of wash water in line 37 may be introduced into the hot overhead line 36 upstream of a cooler at a point in the hot overhead line 36 where the temperature is above the characteristic sublimation temperature of either compound.

The hot gaseous stream may be separated in the cold separator 40 to provide a cold gaseous stream comprising a hydrogen-rich gas stream in a cold overhead line 42 and a cold separated hydroprocessed stream in a cold bottoms line 44. The cold separator 40 serves to separate hydrogen rich gas from hydrocarbon liquid in the hydroprocessed effluent for recycle to the hydroprocessing reactor 30 in the cold overhead line 42. The cold separator 40, therefore, is in downstream communication with the hot overhead line 36 of the hot separator 34 and the hydroprocessing reactor 30. The cold separator 40 may be operated at about 100° F. (38° C.) to about 150° F. (66° C.), suitably about 115° F. (46° C.) to about 145° F. (63° C.), and just below the pressure of the hydroprocessing reactor 30 and the hot separator 34 accounting for pressure drop through intervening equipment to keep hydrogen and light gases in the overhead and normally liquid hydrocarbons in the bottoms. The cold separator 40 may be operated at pressures between about 3 MPa (gauge) (435 psig) and about 20 MPa (gauge) (2,901 psig). The cold separator 40 may also have a boot for collecting an aqueous phase. The cold separated hydroprocessed stream in the cold bottoms line 44 may have a temperature of the operating temperature of the cold separator 40.

The cold gaseous stream in the cold overhead line 42 is rich in hydrogen. Thus, hydrogen can be recovered from the cold gaseous stream. The cold gaseous stream in the cold overhead line 42 may be passed through a trayed or packed recycle scrubbing column 46 where it is scrubbed by means of a scrubbing extraction liquid such as an aqueous solution fed in line 45 to remove acid gases including hydrogen sulfide and carbon dioxide by extracting them into the aqueous solution. Preferred aqueous solutions include lean amines such as alkanolamines DEA, MEA, and MDEA. Other amines can be used in place of or in addition to the preferred amines. The lean amine contacts the cold gaseous stream and absorbs acid gas contaminants such as hydrogen sulfide and carbon dioxide. The resultant "sweetened" cold gaseous stream is taken out from an overhead outlet of the recycle scrubber column 46 in a recycle scrubber overhead line 48, and a rich amine is taken out from the bottoms at a bottom outlet of the recycle scrubber column in a recycle scrubber bottoms line 47. The spent scrubbing liquid from the bottoms may be regenerated and recycled back to the recycle scrubbing column 46. The scrubbed hydrogen-rich stream emerges from the scrubber via the recycle scrubber overhead line 48 and may be compressed in a recycle compressor 50 to provide a recycle hydrogen stream in line 22. The recycle hydrogen stream in line 22 may be supplemented with make-up hydrogen stream in make-up line 24 to provide the hydrogen stream in hydrogen line 20. A portion of the recycle hydrogen stream in line 22 may be routed to the intermediate catalyst bed outlets in the hydroprocessing reactor 30 to control the inlet temperature of the subsequent catalyst bed (not shown). The recycle scrubbing column 46 may be operated with a gas inlet temperature between about 38° C. (100° F.) and about 66° C. (150° F.) and an overhead pressure of about 3 MPa (gauge) (435 psig) to about 20 MPa (gauge) (2900 psig).

The hydrocarbonaceous hot separated hydroprocessed stream in the hot bottoms line 38 may be fractionated as a hot hydroprocessed effluent stream in the product recovery unit 16. In an aspect, the hot separated hydroprocessed stream in the hot bottoms line 38 may be let down in pressure and flashed in a hot flash drum 52 to provide a flash hot gaseous stream of light ends in a hot flash overhead line 54 and a flash hot separated hydroprocessed stream in a hot flash bottoms line 56. The hot flash drum 52 may be any separator that splits the liquid hydroprocessed effluent into vapor and liquid fractions. The hot flash drum 52 may be in direct, downstream communication with the hot bottoms line 38 and in downstream communication with the hydroprocessing reactor 30. The hot flash drum 52 may be operated at the same temperature as the hot separator 34 but at a lower pressure of between about 1.4 MPa (gauge) (200 psig) and about 6.9 MPa (gauge) (1000 psig), suitably no more than about 3.4 MPa (gauge) (500 psig). The flash hot separated hydroprocessed stream in bottoms line 56 may be further fractionated in the product recovery unit 16. The flash hot separated hydroprocessed stream in the hot flash bottoms line 56 may have a temperature of the operating temperature of the hot flash drum 52.

In an aspect, the cold separated hydroprocessed stream in the cold bottoms line 44 may be fractionated as a cold hydroprocessed effluent stream in the product recovery unit 16. In a further aspect, the cold separated hydroprocessed stream may be let down in pressure and flashed in a cold flash drum 60 to separate the cold separated hydroprocessed stream in the bottoms line 44. The cold flash drum 60 may be any separator that splits hydroprocessed effluent into vapor and liquid fractions. The cold flash drum 60 may be in direct downstream communication with the cold bottoms line 44 of the cold separator 40 and in downstream communication with the hydroprocessing reactor 30.

In a further aspect, the flash hot gaseous stream in the hot flash overhead line 54 may be fractionated as a hot hydroprocessed effluent stream in the product recovery unit 16. In a further aspect, the flash hot gaseous stream may be cooled and also separated in the cold flash drum 60. The cold flash drum 60 may separate the cold separated hydroprocessed stream in line 44 and/or the flash hot gaseous stream in hot flash overhead line 54 to provide a flash cold gaseous stream in a cold flash overhead line 62 and a flash cold separated hydroprocessed stream in a cold flash bottoms line 64. In an aspect, light gases such as hydrogen sulfide may be stripped from the flash cold separated hydroprocessed stream. Accordingly, a stripping column 70 may be in downstream communication with the cold flash drum 60 and the cold flash bottoms line 64. The cold flash drum 60 may be in downstream communication with the cold bottoms line 44 of the cold separator 40, the hot flash overhead line 54 of the hot flash drum 52 and the hydroprocessing reactor 30. The cold separated hydroprocessed stream in cold bottoms line 44 and the flash hot gaseous stream in the hot flash overhead line 54 may enter into the cold flash drum 60 either together or separately. In an aspect, the hot flash overhead line 54 joins the cold bottoms line 44 and feeds the flash hot gaseous stream and the cold separated hydroprocessed stream together to the cold flash drum 50 in a cold flash feed line 58. The cold flash drum 50 may be operated at the same temperature as the cold separator 40 but typically at a lower pressure of between about 1.4 MPa (gauge) (200 psig) and about 6.9 MPa (gauge) (1000 psig) and preferably between about 3.0 MPa (gauge) (435 psig) and about 3.4 MPa (gauge) (500 psig). A flashed aqueous stream may be removed from a boot in the cold flash drum 60. The flash cold separated hydroprocessed stream in the cold flash bottoms line 64 may have the same temperature as the operating temperature of the cold flash drum 60. The flash cold gaseous stream in the cold flash overhead line 62 contains substantial hydrogen and may be transported to a hydrodesulfurization reactor 120 to provide hydrogen requirements.

The product recovery section 16 may include the stripping column 70, a product fractionation column 100 and a stabilizing fractionation column 140. The stripping column 70 may be in downstream communication with a bottoms line in the separation section 14 for stripping volatiles from the hydroprocessed streams. For example, the stripping column 70 may be in downstream communication with the hot bottoms line 38, the hot flash bottoms line 56, the cold bottoms line 44, the hot flash overhead line 54 and/or the cold flash bottoms line 64. In an aspect, the stripping column 70 may be a vessel that contains a cold stripping column 72 and a hot stripping column 86. The cold stripping column 72 may be in downstream communication with the hydroprocessing reactor 30, the cold bottoms line 44 and, in an aspect, the cold flash bottoms line 64 for stripping the cold separated hydroprocessed stream. The hot stripping column 86 may be in downstream communication with the hydroprocessing reactor 30 and the hot bottoms line 38 and, in an aspect, the hot flash bottoms line 56 for stripping the hot separated hydroprocessed stream which is hotter than the cold hydroprocessed stream. In an aspect, the cold separated hydroprocessed stream may be the flash cold separated hydroprocessed stream in the cold flash bottoms line 64. The hot separated hydroprocessed stream may be the flash hot separated hydroprocessed stream in the hot flash bottoms line 56. The hot separated hydroprocessed stream may be hotter than the cold separated hydroprocessed stream, by at least 25° C. and preferably at least 50° C.

The cold separated hydroprocessed stream which in an aspect may be the flash cold separated hydroprocessed stream in the cold flash bottoms line 64 may be heated and fed to the cold stripping column 72 at an inlet which may be in a top half of the column. The cold hydroprocessed stream which comprises at least a portion of the hydroprocessed effluent stream in the hydroprocessed effluent line 32 may be stripped in the cold stripping column 72 with a cold stripping media which is an inert gas such as steam from a cold stripping media line 74 to provide a cold stripped overhead stream of naphtha, hydrogen, hydrogen sulfide, steam and other gases in an overhead line 76 and liquid hydroprocessed stream in a cold stripper bottoms line 78 sourced from the separation section 14. The cold stripped overhead stream may be condensed and separated in a receiver 80. A stripper net overhead line 82 from the receiver 80 carries a stripped off gas stream for further treating and potential use as fuel gas. Unstabilized liquid naphtha from the bottoms of the receiver 80 may be split between a reflux portion refluxed to the top of the cold stripping column 72 and a condensed stripped overhead stream which may be transported in a condensed stripper overhead line 84 to naphtha recovery. A sour water stream may be collected from a boot of the overhead receiver 80.

The cold stripping column 72 may be operated with a bottoms temperature between about 149° C. (300° F.) and about 288° C. (550° F.), preferably about 260° C. (500° F.), and an overhead pressure of about 0.35 MPa (gauge) (50 psig), preferably about 0.70 MPa (gauge) (100 psig), to about 2.0 MPa (gauge) (290 psig). The temperature in the overhead receiver 80 ranges from about 38° C. (100° F.) to about 66° C. (150° F.) and the pressure is essentially the same as in the overhead of the cold stripping column 72.

The cold liquid hydroprocessed stream in the cold stripper bottoms line 78 may comprise predominantly naphtha and kerosene boiling materials. Consequently, the cold liquid stream in cold stripper bottoms line 78 may be heated and fed to a product fractionation column 100. The product fractionation column 100 may be in downstream communication with the cold stripped bottoms line 78 of the cold stripping column 72 and the stripping column 70. In an aspect, the product fractionation column 100 may comprise more than one fractionation column. The product fractionation column 100 may be in downstream communication with one, some or all of the hot separator 34, the cold separator 40, the hot flash drum 52 and the cold flash drum 60.

The hot separated hydroprocessed stream which in an aspect may be the flash hot separated hydroprocessed stream in the hot flash bottoms line 56 may be fed to the hot stripping column 86 near a top thereof. The flash hot separated hydroprocessed stream may be stripped in the hot stripping column 86 with a hot stripping media which is an inert gas such as steam from a line 88 to provide a hot stripped overhead stream of naphtha, hydrogen, hydrogen sulfide, steam and other gases in a hot stripper overhead line 90 and hot liquid hydroprocessed stream in a hot stripper bottoms line 92 sourced from the separation section 14. The overhead line 90 may be condensed and a portion refluxed to the hot stripping column 86. However, in the embodiment of the FIGURE, the hot stripped overhead stream in the hot stripper overhead line 90 from the overhead of the hot stripping column 86 may be fed into the cold stripping column 72 directly in an aspect without first condensing or refluxing. The inlet for the cold hydroprocessed effluent stream in the cold flash bottoms line 64 may be at a higher elevation than the inlet for the overhead line 90. The hot stripping column 86 may be operated with a bottoms temperature between about 160° C. (320° F.) and about 360° C. (680° F.) and an overhead pressure of about 0.35 MPa (gauge) (50 psig), preferably about 0.70 Mpa (gauge) (100 psig), to about 2.0 Mpa (gauge) (292 psig).

At least a portion of the hot liquid hydroprocessed stream in the hot stripped bottoms line 92 may be heated and fed to the product fractionation column 100. Consequently, the product fractionation column 100 may be in downstream communication with the hot stripped bottoms line 92 of the hot stripping column 86. The hot liquid hydroprocessed stream in line 92 may be at a hotter temperature than the cold liquid hydroprocessed stream in line 78. In an aspect, the hot liquid hydroprocessed stream may be heated and fed to a prefractionation separator 94 for separation into a vaporized hot hydroprocessed stream in a prefractionation overhead line 96 and a prefractionation hot liquid hydroprocessed stream in a prefractionation bottoms line 98. The prefractionation hot liquid hydroprocessed stream may be heated in a fractionation furnace and fed to the product fractionation column 100 in the prefractionation bottoms line 98 at an elevation below the elevation at which the prefractionation overhead line 96 feeds the vaporized hot liquid hydroprocessed stream to the product fractionation column 100.

The product fractionation column 100 may be in downstream communication with the cold stripping column 72 and the hot stripping column 86 and may comprise more than one fractionation column for separating stripped streams into product streams. The product fractionation column 100 may strip the cold liquid hydroprocessed stream and the hot liquid hydroprocessed stream with an inert stripping media stream such as steam from line 102 to provide several product streams. The product streams from the product fractionation column 100 may include a net fractionated overhead stream comprising naphtha in a net overhead line 104, an optional heavy naphtha stream in line 106 from a side cut outlet, a kerosene stream carried in line 108 from a side cut outlet and a diesel stream in line 110 from a side cut outlet. An unconverted oil stream may be provided in a bottoms line 112 which may be recycled to the hydroprocessing reactor 30. Heat may be removed from the fractionation column 100 by cooling at least a portion of the product streams and sending a portion of each cooled stream back to the fractionation column. These product streams may also be stripped to remove light materials to meet product purity requirements. A fractionated overhead stream in an overhead line 114 may be condensed and separated in a receiver 116 with a portion of the condensed liquid being refluxed back to the fractionation column 100. The net fractionated overhead stream in line 104 may be further processed in the hydrodesulfurization reactor 120. The product fractionation column 100 may be operated with a bottoms temperature between about 260° C. (500° F.), and about 385° C. (725° F.), preferably at no more than about 350° C. (650° F.), and at an overhead pressure between about 7 kPa (gauge) (1 psig) and about 103 kPa (gauge) (15 psig). A portion of the unconverted oil stream in the bottoms line 112 may be reboiled and returned to the product fractionation column 100 instead of adding an inert stripping media stream such as steam in line 102 to heat to the fractionation column 100.

The naphtha in the net fractionated overhead stream in the net overhead line 104 contains too much sulfur to be fed to an isomerization unit or to a catalytic reforming unit because it would rapidly deactivate the catalyst in those respective units. We propose to desulfurize the net fractionated overhead stream in the net overhead line 104 in a post-treat hydrodesulfurization reactor 120.

Additionally, the naphtha in the condensed stripper overhead stream transported in the condensed stripper overhead line 84 contains too much sulfur to be fed to an isomerization unit or to a reformation unit because it would rapidly deactivate the catalyst in those units. We may also propose to desulfurize the condensed stripper overhead stream in the condensed stripper overhead line 84 in a post-treat hydrodesulfurization reactor 120.

We have also found that the flash cold gaseous stream in cold flash overhead line 62 has sufficient hydrogen to supply the hydrogen requirement for a hydrodesulfurization reaction in the post treat hydrodesulfurization reactor 120. The flash cold gaseous stream about 60 to about 90 mol %, suitably about 65 to about 85 mol % and preferably about 70 to about 80 mol % hydrogen purity. The pressure of the flash cold gaseous stream of between about 1.4 Mpa (gauge) (200 psig) and about 6.9 Mpa (gauge) (1000 psig) and preferably between about 3.0 Mpa (gauge) (435 psig) and about 3.4 Mpa (gauge) (500 psig) is sufficient to conduct hydrodesulfurization of naphtha without requiring a compressor for fresh make up gas or for recycle gas. The post treat hydrodesulfurization reactor 120 may be run with the hydrogen provided once through, without recycle of a hydrogen stream. Accordingly, the post-treat hydrodesulfurization reactor 120 may be in downstream communication with the cold flash overhead line 62 of the cold flash drum 60.

The net fractionation overhead stream in the net overhead line 104 may be desulfurized in the post treat hydrodesulfurization reactor 120 by itself, so the post-treat hydrodesulfurization reactor 120 may be in downstream communication with the product fractionation column 100. Particularly, the post-treat hydrodesulfurization reactor 120 may be in downstream communication with the net overhead line 104 of said product fractionation column. Moreover, the condensed stripper overhead stream in the condensed stripper overhead line 84 may be desulfurized in the post treat hydrodesulfurization reactor 120 by itself, so the post-treat hydrodesulfurization reactor 120 may be in downstream communication with the condensed stripper overhead line 84 of the stripper column 70. In an embodiment, the condensed stripper overhead stream in the condensed stripper overhead line 84 and the net fractionation overhead stream in the net overhead line 104 may be desulfurized together in the post treat hydrodesulfurization reactor 120. The post-treat desulfurization of naphtha will be described with the condensed stripper overhead stream in the condensed stripper overhead line 84 and the net fractionation overhead stream in the net overhead line 104 being desulfurized together with the understanding that each of these naphtha streams could alternatively be desulfurized alone. The condensed stripper overhead stream in the condensed stripper overhead line 84 and the net fractionation overhead stream in the net overhead line 104 may be mixed together and transported in a desulfurization feed line 122.

A hydrogen stream such as the flash cold gaseous stream in the cold flash overhead line 62 may be added to the condensed stripper overhead stream in the condensed stripper overhead line 84 and/or the net fractionation overhead stream in the net overhead line 104 and transported to the post-treat reactor 120 in a hydrodesulfurization feed line 124. The flash cold gaseous stream in the cold flash overhead line 62 may provide all the hydrogen requirements for hydrodesulfurizing the condensed stripper overhead stream from the condensed stripper overhead line 84 and/or the net fractionation overhead stream from the net overhead line 104. Hydrodesulfurization of naphtha typically begins with heating the condensed stripper overhead stream from the condensed stripper overhead line 84 and/or the net fractionation overhead stream from the net overhead line 104. The condensed stripper overhead stream and/or the net fractionation overhead stream can be contacted with a hydrogen stream such as the flash cold gaseous stream prior to, during or after preheating. The hydrogen stream such as the flash cold gaseous stream may also be added directly to the hydrodesulfurization reactor 120. The condensed stripper overhead stream from the condensed stripper overhead line 84 and/or the net fractionation overhead stream from the net overhead line 104 in the hydrodesulfurization feed line 124 may be heat exchanged with a hydrodesulfurized effluent stream in hydrodesulfurized effluent line 128 and perhaps with another stream to achieve hydrodesulfurization reaction temperature and fed to the hydrodesulfurization post-treat reactor 120.

The condensed stripper overhead stream from the condensed stripper overhead line 84 and/or the net fractionation overhead stream from the net overhead line 104 in the hydrodesulfurization feed line 124 may be fed to the post-treat hydrodesulfurization reactor 120 to further convert organic sulfur in the naphtha to hydrogen sulfide by hydrodesulfurization with hydrogen. Organic nitrogen in the hydrodesulfurization feed line 124 will also be converted to ammonia in the post-treat hydrodesulfurization reactor 120. The post-treat hydrodesulfurization reactor may comprise one or more beds 126 of hydrodesulfurization catalyst. The hydrodesulfurization catalyst may have a support that comprises an inorganic oxide such as alumina and catalytic desulfurization metals can be deposited on the support including from about 2 to about 20 wt % Group VI or Group VIII metals such as cobalt, nickel, molybdenum and/or tungsten as previously explained. The layered sphere catalyst of U.S. Pat. No. 7,629,289 may be a suitable hydrodesulfurization catalyst.

Hydrodesulfurization conditions preferably include a temperature from about 240° C. (400° F.) to about 399° C. (750° F.) and a pressure from about 790 kPa (100 psig) to about 3.5 Mpa (500 psig). The hydrogen stream purity is preferably at least about 65 vol % hydrogen and more preferably at least 75 vol % hydrogen for best results. Desulfurized naphtha is provided in hydrodesulfurized effluent stream in hydrodesulfurized effluent line 128.

The hydrodesulfurized effluent stream in hydrodesulfurized effluent line 128 may be heat exchanged with the condensed stripper overhead stream and/or the net fractionation overhead stream in the hydrodesulfurization feed line 124 to condense a portion of the hydrodesulfurized effluent stream. The hydrodesulfurized effluent stream may be fed to a hydrodesulfurization separator 130 to provide a vaporous hydrodesulfurized stream in hydrodesulfurization overhead line 132 and a liquid hydrodesulfurized stream in a hydrodesulfurization bottoms line 134. The hydrodesulfurization separator 130 may be operated at about 38° C. (100° F.) to about 66° C. (150° F.), suitably about 46° C. (115° F.) to about 145° F. (63° C.), and just below the pressure of the hydrodesulfurization reactor 120 accounting for pressure drop through intervening equipment to keep hydrogen and light gases in the vaporous hydrodesulfurized stream and normally liquid hydrocarbons in the liquid hydrodesulfurized stream.

The liquid hydrodesulfurized stream may be heated and fractionated in a stabilizing fractionation column 140 to provide a hydrodesulfurized naphtha stream. The stabilizing fractionation column 140 may be in downstream communication with the post-treat hydrodesulfurization reactor 120. In an aspect, a net overhead stream comprising $C_2$−, $C_3$− or $C_4$− hydrocarbons and light gasses are recovered in a net overhead line 142 after condensation and reflux of condensed overhead liquid. The stabilizing column 140 provides a hydrodesulfurized naphtha stream comprising $C_3$+, $C_4$+ or $C_5$+ hydrocarbons in a stabilized bottoms line 144 with less than about 0.5 wppm sulfur. A portion of the hydrodesulfurized naphtha stream in stabilized bottoms line 144 may be reboiled and returned to the stabilizing fractionation column 140 to provide heat to the column. It is contemplated that other fractionation columns may be provided downstream or upstream of the stabilizing fractionation column to provide recovery of other light hydrocarbons. The hydrodesulfurized naphtha stream in stabilized bottoms line 144 may be delivered to a naphtha splitter to split light naphtha for isomerization from heavy naphtha for reforming. The stabilizing fractionation column 140 may be operated with a bottoms temperature between about 160° C. (320° F.) and about 220° C. (430° F.) and an overhead pressure of about 0.8 Mpa (gauge) (120 psig) to about 2 Mpa (gauge) (300 psig).

The vaporous hydrodesulfurized stream may comprise substantial hydrogen that can still be recovered. Accordingly, the vaporous hydrodesulfurized stream in hydrodesulfurization overhead line 132 may be scrubbed by contact with a scrubbing solution in a hydrodesulfurization scrubber column 150. A preferred scrubbing solution includes lean amines such as alkanolamines, DEA, MEA, and MDEA. Other amines can be used in place of or in addition to the preferred amines. The lean amine fed from line 152 at the top of the scrubbing column contacts the vaporous hydrodesulfurized stream counter currently and absorbs acid gas contaminants such as hydrogen sulfide and carbon dioxide. The resultant "sweetened" absorbed, hydrodesulfurized stream is taken out from an overhead outlet of the hydrodesulfurization scrubber column in a hydrodesulfurization scrubber overhead line 154, and a rich amine is taken out from the bottoms at a bottom outlet of the hydrodesulfurization scrubber column in scrubber bottoms line 156. The rich amine may undergo regeneration to remove the hydrogen sulfide for processing to generate elemental sulfur. The hydrodesulfurization scrubbing column 150 may be operated with a gas inlet temperature between about 30° C.

(86° F.) and about 66° C. (150° F.) and an overhead pressure of about 1.2 Mpa (gauge) (175 psig) to about 3.2 Mpa (gauge) (465 psig).

The absorbed, hydrodesulfurized stream in the hydrodesulfurization scrubber overhead line 154 may be fed to a hydrogen recovery unit 160 which may comprise a pressure swing adsorption (PSA) unit 162 to adsorb impurities from hydrogen in the absorbed, hydrodesulfurized stream in the hydrodesulfurization overhead line 154. The hydrogen recovery unit 160 may also comprise a membrane unit. In the PSA unit 160, impurities are adsorbed from hydrogen in the absorbed, hydrodesulfurized stream to provide a tail gas stream in tail gas line 164 and a purified hydrogen stream in product line 166. The pressure swing adsorption process separates hydrogen from larger molecules in the hydrodesulfurization scrubber overhead line 154. The larger molecules are adsorbed on an adsorbent at a high adsorption pressure while allowing passage of the smaller hydrogen molecules. Pressure reduction is effected to a lower desorption pressure to desorb the adsorbed larger molecules. It is generally desirable to employ the PSA process in multiple bed systems such as those described in U.S. Pat. No. 3,430,418, in which at least four adsorption beds are employed. The PSA process is carried out in such systems on a cyclical basis, employing a processing sequence. The purified hydrogen stream in product line 166 has a reduced concentration of hydrogen sulfide, ammonia, amines and hydrocarbons and a greater hydrogen purity than in the absorbed, hydrodesulfurized stream in the hydrodesulfurization scrubber overhead line 154. The PSA unit 162 may be in direct, downstream communication with the hydrodesulfurization scrubber overhead line 154.

Specific Embodiments

While the following is described in conjunction with specific embodiments, it will be understood that this description is intended to illustrate and not limit the scope of the preceding description and the appended claims.

A first embodiment of the invention is a process for desulfurizing naphtha comprising hydroprocessing a hydrocarbon feed stream in a hydroprocessing reactor to provide a hydroprocessed effluent stream; separating the hydroprocessed effluent stream; fractionating a liquid hydroprocessed stream from the separation step; hydrodesulfurizing a fractionated overhead stream from the fractionation step with hydrogen; and fractionating a hydrodesulfurized stream from the hydrodesulfurizing step to provide a hydrodesulfurized naphtha stream. An embodiment of the invention is one, any or all of prior embodiments in this paragraph up through the first embodiment in this paragraph wherein separating the hydroprocessed effluent stream provides a separated hydroprocessed stream and further comprising stripping the separated hydroprocessed stream to provide the liquid hydroprocessed stream. An embodiment of the invention is one, any or all of prior embodiments in this paragraph up through the first embodiment in this paragraph wherein the stripping step further comprises providing a stripper overhead stream and hydrodesulfurizing the stripper overhead stream. An embodiment of the invention is one, any or all of prior embodiments in this paragraph up through the first embodiment in this paragraph wherein the stripping step further comprises providing a stripper overhead stream, condensing the stripper overhead stream to provide a condensed stripper overhead stream and hydrodesulfurizing the condensed stripper overhead stream. An embodiment of the invention is one, any or all of prior embodiments in this paragraph up through the first embodiment in this paragraph further comprising hydrodesulfurizing the fractionated overhead stream with the condensed stripper overhead stream to provide the hydrodesulfurized stream. An embodiment of the invention is one, any or all of prior embodiments in this paragraph up through the first embodiment in this paragraph wherein the separation step provides a gaseous hydroprocessed stream that provides the hydrogen for the hydrodesulfurizing step. An embodiment of the invention is one, any or all of prior embodiments in this paragraph up through the first embodiment in this paragraph wherein the separation step further comprises separating the hydroprocessed effluent stream in a hot separator to provide a hot gaseous stream and a hot liquid stream; separating the hot gaseous stream in a cold separator to provide a cold gaseous stream and a cold liquid stream and/or separating the hot liquid stream in a hot flash drum to provide a flash hot gaseous stream and a flash hot liquid stream; and separating the flash hot gaseous stream and/or the cold liquid stream in a cold flash drum to provide a flash cold gaseous stream, which is the gaseous hydroprocessed stream, and a flash cold liquid stream. An embodiment of the invention is one, any or all of prior embodiments in this paragraph up through the first embodiment in this paragraph further comprising stripping the flash cold liquid stream and/or the flash hot liquid stream to provide the liquid hydroprocessed stream and optionally another liquid hydroprocessed stream. An embodiment of the invention is one, any or all of prior embodiments in this paragraph up through the first embodiment in this paragraph further comprising separating a hydrodesulfurized effluent stream to provide a vaporous hydrodesulfurized stream and a liquid hydrodesulfurized stream and fractionating the liquid hydrodesulfurized stream. An embodiment of the invention is one, any or all of prior embodiments in this paragraph up through the first embodiment in this paragraph further comprising absorbing acid gases from the vaporous hydrodesulfurized stream to provide an absorbed, hydrodesulfurized stream and adsorbing impurities from hydrogen in the absorbed, hydrodesulfurized stream.

A second embodiment of the invention is a process for desulfurizing naphtha comprising hydroprocessing a hydrocarbon feed stream in a hydroprocessing reactor to provide a hydroprocessed effluent stream; separating the hydroprocessed effluent stream to provide a gaseous hydroprocessed stream and a liquid hydroprocessed stream; stripping the liquid hydroprocessed stream to provide a stripped, liquid hydroprocessed stream; fractionating the stripped, liquid hydroprocessed stream to provide a fractionated overhead stream; and hydrodesulfurizing a fractionated overhead stream with hydrogen from the gaseous hydroprocessed stream. An embodiment of the invention is one, any or all of prior embodiments in this paragraph up through the second embodiment in this paragraph wherein the stripping step further comprises providing a stripper overhead stream, condensing the stripper overhead stream to provide a condensed stripper overhead stream and hydrodesulfurizing the condensed stripper overhead stream. An embodiment of the invention is one, any or all of prior embodiments in this paragraph up through the second embodiment in this paragraph further comprising hydrodesulfurizing the fractionated overhead stream with the condensed stripper overhead stream. An embodiment of the invention is one, any or all of prior embodiments in this paragraph up through the second embodiment in this paragraph wherein the separation step further comprises separating the hydroprocessed effluent stream in a hot separator to provide a hot gaseous stream and a hot liquid stream; separating the hot gaseous stream in a cold separator to provide a cold gaseous stream and a cold liquid stream and/or separating the hot liquid stream in a hot flash drum to provide a flash hot gaseous stream and a flash hot liquid stream; separating the flash hot gaseous stream and/or the cold liquid stream in a cold flash drum to provide a flash cold gaseous stream, which is the gaseous hydroprocessed stream, and a flash cold liquid stream; and the liquid hydroprocessed stream is one of the flash cold liquid stream and the flash hot liquid stream. An embodiment of the invention is one, any or all of prior embodiments in this paragraph up through the second embodiment in this paragraph further comprising fractionating a hydrodesulfurized stream from the hydrodesulfurization step to provide a hydrodesulfurized naphtha stream.

A third embodiment of the invention is an apparatus for desulfurizing naphtha comprising a hydroprocessing reactor; a separator in downstream communication with the hydroprocessing reactor; a product fractionation column in downstream communication with the separator; a post-treat hydrodesulfurization reactor in downstream communication with the product fractionation column; and a stabilizing fractionation column in downstream communication with the post-treat hydrodesulfurization reactor. An embodiment of the invention is one, any or all of prior embodiments in this paragraph up through the third embodiment in this paragraph wherein the post treat hydrodesulfurization reactor is in downstream communication with an overhead line of the separator. An embodiment of the invention is one, any or all of prior embodiments in this paragraph up through the third embodiment in this paragraph further comprising a stripping column in downstream communication with a bottom line of the separator and the product fractionation column is in downstream communication with the stripping column. An embodiment of the invention is one, any or all of prior embodiments in this paragraph up through the third embodiment in this paragraph wherein the post-treat hydrodesulfurization reactor is in downstream communication with an overhead line of the stripping column and the product fractionation column. An embodiment of the invention is one, any or all of prior embodiments in this paragraph up through the third embodiment in this paragraph wherein the post-treat hydrodesulfurization reactor is in downstream communication with an overhead line of the product fractionation column.

A fourth embodiment of the invention is a process for desulfurizing naphtha comprising hydroprocessing a hydrocarbon feed stream in a hydroprocessing reactor to provide a hydroprocessed effluent stream; separating the hydroprocessed effluent stream to provide a separated liquid hydroprocessed stream; stripping the separated hydroprocessed stream to provide a stripped liquid hydroprocessed stream; and hydrodesulfurizing a stripper overhead stream from the stripping step with hydrogen. An embodiment of the invention is one, any or all of prior embodiments in this paragraph up through the fourth embodiment in this paragraph wherein the stripping step further comprises providing a stripper overhead stream, condensing the stripper overhead stream to provide a condensed stripper overhead stream and the stripper overhead stream is the condensed, stripper overhead stream. An embodiment of the invention is one, any or all of prior embodiments in this paragraph up through the fourth embodiment in this paragraph further comprising fractionating a hydrodesulfurized stream from the hydrodesulfurizing step to provide a hydrodesulfurized naphtha stream. An embodiment of the invention is one, any or all of prior embodiments in this paragraph up through the fourth embodiment in this paragraph further comprising fractionating the stripped liquid hydroprocessed stream to provide a fractionated overhead stream and hydrodesulfurizing the fractionated overhead stream. An embodiment of the invention is one, any or all of prior embodiments in this paragraph up through the fourth embodiment in this paragraph further comprising hydrodesulfurizing the fractionated overhead stream with the condensed stripper overhead stream to provide the hydrodesulfurized stream. An embodiment of the invention is one, any or all of prior embodiments in this paragraph up through the fourth embodiment in this paragraph wherein the separation step provides a gaseous hydroprocessed stream that provides the hydrogen for the hydrodesulfurizing step. An embodiment of the invention is one, any or all of prior embodiments in this paragraph up through the fourth embodiment in this paragraph wherein the separation step further comprises separating the hydroprocessed effluent stream in a hot separator to provide a hot gaseous stream and a hot liquid stream; separating the hot gaseous stream in a cold separator to provide a cold gaseous stream and a cold liquid stream and/or separating the hot liquid stream in a hot flash drum to provide a flash hot gaseous stream and a flash hot liquid stream; and separating the flash hot gaseous stream and/or the cold liquid stream in a cold flash drum to provide a flash cold gaseous stream, which is the gaseous hydroprocessed stream, and a flash cold liquid stream comprising the liquid separated hydroprocessed stream. An embodiment of the invention is one, any or all of prior embodiments in this paragraph up through the fourth embodiment in this paragraph wherein stripping the flash hot liquid stream provides another stripped liquid hydroprocessed stream. An embodiment of the invention is one, any or all of prior embodiments in this paragraph up through the fourth embodiment in this paragraph further comprising separating the hydrodesulfurized stream to provide a vaporous hydrodesulfurized stream and a liquid hydrodesulfurized stream and the hydrodesulfurized stream is the liquid hydrodesulfurized stream. An embodiment of the invention is one, any or all of prior embodiments in this paragraph up through the fourth embodiment in this paragraph further comprising absorbing acid gases from the vaporous hydrodesulfurized stream to provide an absorbed, hydrodesulfurized stream and adsorbing impurities from hydrogen in the absorbed, hydrodesulfurized stream.

A fifth embodiment of the invention is a process for desulfurizing naphtha comprising hydroprocessing a hydrocarbon feed stream in a hydroprocessing reactor to provide a hydroprocessed effluent stream; separating the hydroprocessed effluent stream to provide a gaseous separated hydroprocessed stream and a liquid separated hydroprocessed stream; stripping the separated liquid hydroprocessed stream to provide a stripped, liquid hydroprocessed stream; and hydrodesulfurizing a stripper overhead stream from the stripping step with hydrogen from the gaseous hydroprocessed stream. An embodiment of the invention is one, any or all of prior embodiments in this paragraph up through the fifth embodiment in this paragraph wherein the stripping step further comprises providing a stripper overhead stream, condensing the stripper overhead stream to provide a condensed stripper overhead stream and the stripper overhead stream is the condensed, stripper overhead stream. An embodiment of the invention is one, any or all of prior embodiments in this paragraph up through the fifth embodiment in this paragraph further comprising fractionating a hydrodesulfurized stream from the hydrodesulfurizing step to provide a hydrodesulfurized naphtha stream. An embodiment of the invention is one, any or all of prior embodiments in this paragraph up through the fifth embodiment in this paragraph further comprising fractionating the stripped liquid hydroprocessed stream to provide a fractionated overhead stream and hydrodesulfurizing the fractionated overhead stream with the condensed stripper overhead stream to provide the hydrodesulfurized stream. An embodiment of the invention is one, any or all of prior embodiments in this paragraph up through the fifth embodiment in this paragraph wherein the separation step further comprises separating the hydroprocessed effluent stream in a hot separator to provide a hot gaseous stream and a hot liquid stream; separating the hot gaseous stream in a cold separator to provide a cold gaseous stream and a cold liquid stream and/or separating the hot liquid stream in a hot flash drum to provide a flash hot gaseous stream and a flash hot liquid stream; and separating the flash hot gaseous stream and/or the cold liquid stream in a cold flash drum to provide a flash cold gaseous stream, which is the gaseous hydroprocessed stream, and a flash cold liquid stream comprising the liquid separated hydroprocessed stream.

A sixth embodiment of the invention is an apparatus for desulfurizing naphtha comprising a hydroprocessing reactor; a separator in downstream communication with the hydroprocessing reactor; a stripping column in downstream communication with a bottom line of the separator; and a post-treat hydrodesulfurization reactor in downstream communication with the stripping column. a stabilizing fractionation column in downstream communication with the post-treat hydrodesulfurization reactor. An embodiment of the invention is one, any or all of prior embodiments in this paragraph up through the sixth embodiment in this paragraph wherein the post treat hydrodesulfurization reactor is in downstream communication with an overhead line of the separator. An embodiment of the invention is one, any or all of prior embodiments in this paragraph up through the sixth embodiment in this paragraph further comprising a product fractionation column in downstream communication with the stripping column and the post-treat hydrodesulfurization reactor is in downstream communication with the product fractionation column. An embodiment of the invention is one, any or all of prior embodiments in this paragraph up through the sixth embodiment in this paragraph wherein the post-treat hydrodesulfurization reactor is in downstream communication with an overhead line of the stripping column. An embodiment of the invention is one, any or all of prior embodiments in this paragraph up through the sixth embodiment in this paragraph wherein the post-treat hydrodesulfurization reactor is in downstream communication with an overhead line of the product fractionation column.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for desulfurizing naphtha comprising:

hydroprocessing a hydrocarbon feed stream in a hydroprocessing reactor to provide a hydroprocessed effluent stream;

separating said hydroprocessed effluent stream;

fractionating a liquid hydroprocessed stream from said separation step;

hydrodesulfurizing a fractionated overhead stream from said fractionation step with hydrogen; and fractionating a hydrodesulfurized stream from said hydrodesulfurizing step to provide a hydrodesulfurized naphtha stream.

2. The process of claim 1 wherein separating said hydroprocessed effluent stream provides a separated hydroprocessed stream and further comprising stripping said separated hydroprocessed stream to provide said liquid hydroprocessed stream.

3. The process of claim 2 wherein said stripping step further comprises providing a stripper overhead stream and hydrodesulfurizing said stripper overhead stream.

4. The process of claim 2 wherein said stripping step further comprises providing a stripper overhead stream, condensing said stripper overhead stream to provide a condensed stripper overhead stream and hydrodesulfurizing said condensed stripper overhead stream.

5. The process of claim 4 further comprising hydrodesulfurizing said fractionated overhead stream with said condensed stripper overhead stream to provide said hydrodesulfurized stream.

6. The process of claim 1 wherein said separation step provides a gaseous hydroprocessed stream that provides the hydrogen for the hydrodesulfurizing step.

7. The process of claim 6 wherein said separation step further comprises: separating said hydroprocessed effluent stream in a hot separator to provide a hot gaseous stream and a hot liquid stream; separating said hot gaseous stream in a cold separator to provide a cold gaseous stream and a cold liquid stream and/or separating said hot liquid stream in a hot flash drum to provide a flash hot gaseous stream and a flash hot liquid stream; and separating said flash hot gaseous stream and/or said cold liquid stream in a cold flash drum to provide a flash cold gaseous stream, which is said gaseous hydroprocessed stream, and a flash cold liquid stream.

8. The process of claim 7 further comprising stripping said flash cold liquid stream and/or said flash hot liquid stream to provide said liquid hydroprocessed stream and optionally another liquid hydroprocessed stream.

9. The process of claim 1 further comprising separating a hydrodesulfurized effluent stream to provide a vaporous hydrodesulfurized stream and a liquid hydrodesulfurized stream and fractionating said liquid hydrodesulfurized stream.

10. The process of claim 9 further comprising absorbing acid gases from said vaporous hydrodesulfurized stream to provide an absorbed, hydrodesulfurized stream and adsorbing impurities from hydrogen in said absorbed, hydrodesulfurized stream.

11. A process for desulfurizing naphtha comprising:

hydroprocessing a hydrocarbon feed stream in a hydroprocessing reactor to provide a hydroprocessed effluent stream;

separating said hydroprocessed effluent stream to provide a gaseous hydroprocessed stream and a liquid hydroprocessed stream;

stripping said liquid hydroprocessed stream to provide a stripped, liquid hydroprocessed stream;

fractionating said stripped, liquid hydroprocessed stream to provide a fractionated overhead stream; and hydrodesulfurizing a fractionated overhead stream with hydrogen from said gaseous hydroprocessed stream.

12. The process of claim 11 wherein said stripping step further comprises providing a stripper overhead stream, condensing said stripper overhead stream to provide a condensed stripper overhead stream and hydrodesulfurizing said condensed stripper overhead stream.

13. The process of claim 12 further comprising hydrodesulfurizing said fractionated overhead stream with said condensed stripper overhead stream.

14. The process of claim 11 wherein said separation step further comprises: separating said hydroprocessed effluent stream in a hot separator to provide a hot gaseous stream and a hot liquid stream; separating said hot gaseous stream in a cold separator to provide a cold gaseous stream and a cold liquid stream and/or separating said hot liquid stream in a hot flash drum to provide a flash hot gaseous stream and a flash hot liquid stream; separating said flash hot gaseous stream and/or said cold liquid stream in a cold flash drum to provide a flash cold gaseous stream, which is said gaseous hydroprocessed stream, and a flash cold liquid stream; and said liquid hydroprocessed stream is one of said flash cold liquid stream and said flash hot liquid stream.

15. The process of claim 14 further comprising fractionating a hydrodesulfurized stream from said hydrodesulfurization step to provide a hydrodesulfurized naphtha stream.

16. An apparatus for desulfurizing naphtha comprising:

a hydroprocessing reactor;

a separator in downstream communication with said hydroprocessing reactor;

a product fractionation column in downstream communication with said separator;

a post-treat hydrodesulfurization reactor in downstream communication with said product fractionation column; and a stabilizing fractionation column in downstream communication with said post-treat hydrodesulfurization reactor.

17. The apparatus of claim 16 wherein said post treat hydrodesulfurization reactor is in downstream communication with an overhead line of said separator.

18. The apparatus of claim 16 further comprising a stripping column in downstream communication with a bottom line of said separator and said product fractionation column is in downstream communication with said stripping column.

19. The apparatus of claim 18 wherein said post-treat hydrodesulfurization reactor is in downstream communication with an overhead line of said stripping column.

20. The apparatus of claim 19 wherein said post-treat hydrodesulfurization reactor is in downstream communication with an overhead line of said product fractionation column.

* * * * *